US007828607B2

(12) United States Patent
Kojima

(10) Patent No.: US 7,828,607 B2
(45) Date of Patent: Nov. 9, 2010

(54) CONNECTOR

(75) Inventor: Eiji Kojima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/467,371

(22) Filed: May 18, 2009

(65) Prior Publication Data

US 2009/0298353 A1 Dec. 3, 2009

(30) Foreign Application Priority Data

Jun. 3, 2008 (JP) ..... 2008-146110

(51) Int. Cl.
*H01R 13/514* (2006.01)

(52) U.S. Cl. ..... 439/752; 439/595

(58) Field of Classification Search ..... 439/595, 439/751, 752

See application file for complete search history.

(56) References Cited

U.S. PATENT DOCUMENTS 5,358,427 A * 10/1994 Miwa ..... 439/595
5,474,477 A * 12/1995 Aoyama ..... 439/752
5,516,308 A * 5/1996 Yamanashi ..... 439/752
5,586,917 A * 12/1996 Yagi et al. ..... 439/752
5,738,551 A * 4/1998 Matsuoka ..... 439/752
5,797,772 A * 8/1998 Sakurai et al. ..... 439/752
6,390,859 B2 5/2002 Furutani
6,935,904 B2 * 8/2005 Ishiyama ..... 439/752
7,204,725 B2 * 4/2007 Yamashita ..... 439/752
7,252,557 B2 * 8/2007 Nakamura et al. ..... 439/752
7,500,887 B2 * 3/2009 Ichio ..... 439/752

* cited by examiner

*Primary Examiner*—Thanh-Tam T Le
(74) *Attorney, Agent, or Firm*—Gerald E. Hespos; Michael J. Porco

(57) ABSTRACT

A connector is provided with a housing 10 fittable into a receptacle 52 of a mating connector 50 and a retainer 20 to be inserted into the housing 10 sideways. Cavities 12A, 12B for accommodating terminals are arranged side by side in the housing. The retainer 20 includes a main body 21 with side by side engaging portions 26A, 26B for engaging the terminals. Side walls 31 are provided at the opposite ends in an arrangement direction of the engaging portions 26A, 26B and projecting forward from the main body 21 in a connecting direction with the mating connector 50. Reinforcements 34 project in from front end portions of the side walls 31 in the connecting direction with the mating connector 50 and are at the rear ends of the side walls 31 in an inserting direction of the retainer 20 into the housing 10.

11 Claims, 7 Drawing Sheets

CONNECTOR

BACKGROUND OF THE INVENTION

1. Field of the Invention

The invention relates to a connector mounted with a side type retainer.

2. Description of the Related Art

Known connectors include housings for receiving terminals and retainers that can be inserted through side surfaces of housings for doubly locking the terminals. A part of the retainer projects from the side surface of the housing if the retainer is inserted insufficiently into the housing. This projecting part of the retainer contacts the receptacle of a mating connector to hinder connection and to detect insufficient insertion of the retainer. Thus, the retainer is reinserted and the terminals are locked redundantly at proper positions.

Side type retainers are made in various shapes. For example, U.S. Pat. No. 6,390,859 discloses a retainer with a main body that has terminal engaging portions arranged side by side. Side walls are formed at the opposite sides of the main body. The side walls on retainers of this type generally project more forward than the main body in a connecting direction with a mating connector, and are mounted in the corresponding connectors in correct combinations by making a projecting distance of the side walls from the main body differ depending on the number of the terminals mounted in the connector. However, only the front ends of the side walls of the above-described connector contact the receptacle if the retainer is inserted insufficiently. Thus, the side walls may be deformed or damaged and a connector connecting operation may be completed despite the insufficiently inserted state of the retainer if the connector is connected vigorously.

Thicker side walls would be stronger and would detect the insufficient insertion of the retainer more reliably. However, thicker side walls also produce and undesirable widening of the connector.

A coupling could be provided on the inner surfaces of the side walls for integrally coupling and reinforcing the bottom ends of the opposite side walls at locations that will contact the receptacle if the retainer is inserted insufficiently. However, a recess then is needed in a wall of the housing adjacent the retainer insertion opening to accommodate the coupling. Thus, the wall of the housing is thinned undesirably in the width direction by as much as this recess. The thinner wall of the housing is weaker. Additionally, the flow of resin deteriorates and the poor resin flow may adversely affect parts to become locking lances for primarily locking the terminals. The wall of the housing could be thickened to cope with this problem. However, the thicker wall undesirably enlarges the connector in a height direction and increases material costs.

The invention was developed in view of the above situation, and an object thereof is to provide a connector capable of reliably detecting the insufficient insertion of a retainer without being enlarged.

SUMMARY OF THE INVENTION

The invention relates to a connector with a housing that can fit into a receptacle of a mating connector. At least one cavity is formed in the housing for accommodating at least one terminal. The connector also has at least one retainer that can be inserted into the housing in an inserting direction aligned at an angle to a connecting direction of the connector with the mating connector. The retainer includes a main body with at least one engaging portion that is engageable with the terminal in the cavity. Side walls project forward from the main body in the connecting direction of the connector with the mating connector. Reinforcements project in from front ends of the side walls in the connecting direction of the connector with the mating connector and at the rear ends of the side walls in the inserting direction of the retainer into the housing.

The housing preferably has a plurality of cavities arranged side by side in the housing and the main body of the retainer preferably has a corresponding plurality of side by side engaging portions for engaging the terminals. The side walls are at opposite ends of the main body in an arrangement direction of the engaging portions.

The reinforcements strengthen parts of the retainer that contact the receptacle when the retainer is inserted insufficiently. These reinforced parts are not likely to be damaged by contact with a mating connector. Therefore the insufficient insertion of the retainer can be detected reliably. Additionally, the reinforcements are at the rear ends of the side walls in the inserting direction of the retainer and project in from the front end portions of the side wall portions. Thus, it is not necessary to increase the thickness of the entire side walls and widen the connector in the arrangement direction of the cavities. Further, the housing wall is thinned to form recesses for the reinforcements only at the opposite ends of the housing. Thus, influence on the flow of resin can be suppressed to a minimum level and the housing walls need not be thickened. Accordingly, the insufficient insertion of the retainer is detected reliably without enlarging the connector.

Large and small terminals may be accommodated in the housing. The small terminals preferably are in a middle part of the housing in the arrangement direction of the cavities and the large terminals are at opposite sides of the housing. Accordingly, the thickness of the housing wall at the opposite widthwise sides inevitably increases as compared with the case where the small terminals are at the opposite sides. Thus, the recesses for the reinforcements are in the parts of the housing where the wall thickness inevitably is large to reduce the influence on the flow of resin even more.

The side walls and the reinforcements preferably are integral or unitary with one another.

The reinforcements preferably are continuous with the rear ends of the side walls with respect to the inserting direction and are at an angle to the side walls. Thus, the reinforcements and the side walls are substantially L-shaped when the retainer is viewed along the connecting direction.

A dimension of the reinforcements in forward and backward directions preferably is substantially equal to a projecting distance of the side walls from base walls, so that the front end surfaces of the reinforcements and the front surfaces of the side walls form substantially flat contact surfaces.

Front end surfaces of the reinforcements and front surfaces of the side walls preferably form contact surfaces that are substantially parallel to the front surface of the main body of the retainer and that are substantially orthogonal to the connecting direction of the connectors.

The contact surfaces preferably are substantially L-shaped when viewed in the connecting direction.

The retainer preferably is configured to push any insufficiently inserted terminals forward to proper positions as the retainer is being inserted into the housing.

These and other objects, features and advantages of the invention will be more apparent upon reading the following detailed description of preferred embodiments and accompanying drawings.

DETAILED DESCRIPTION OF THE PREFERRED EMBODIMENTS

Figure 1:
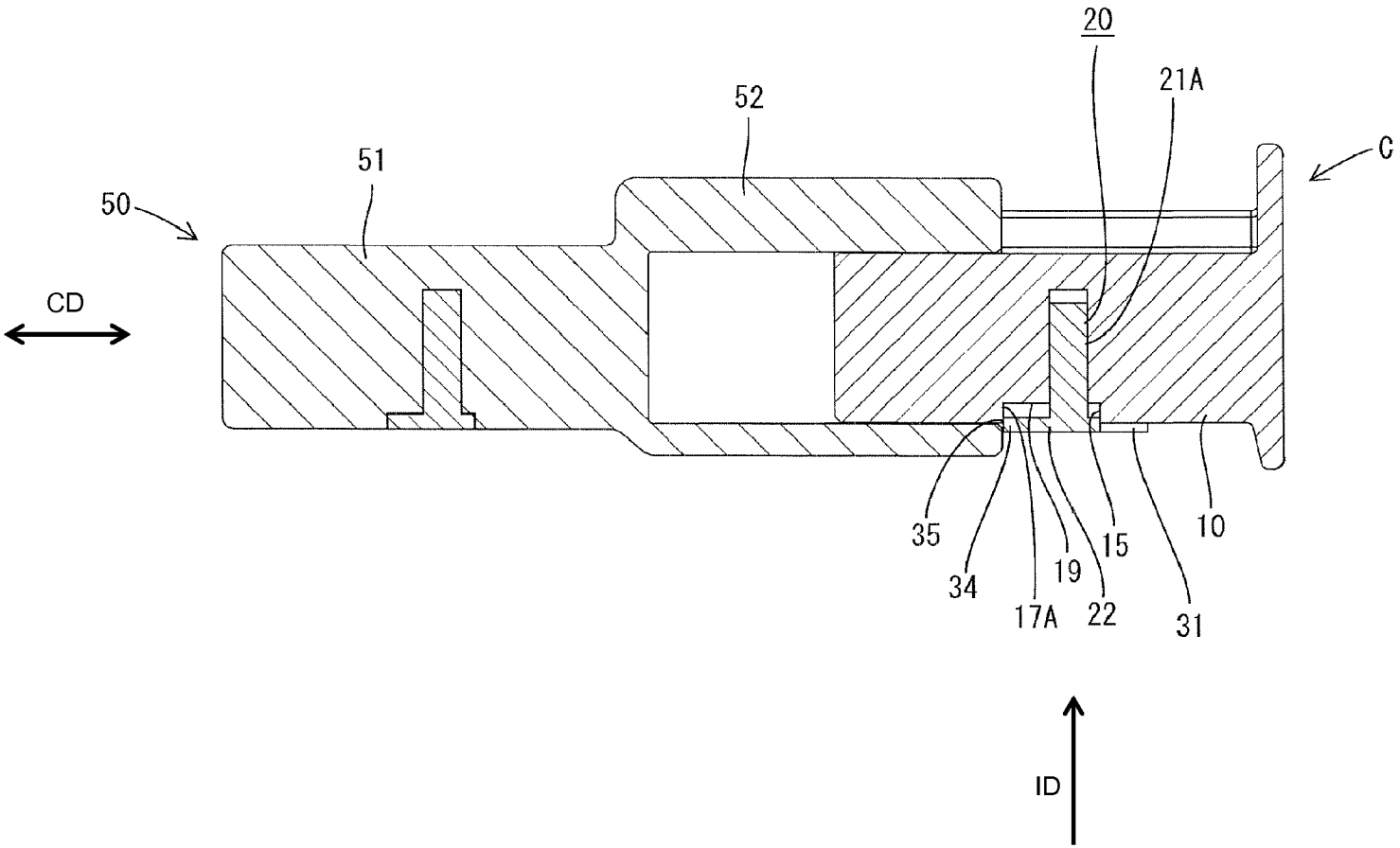
FIG. 1 is a section showing a state where an insufficiently inserted retainer is in contact with a receptacle in a connector of one embodiment.
Figure 2:
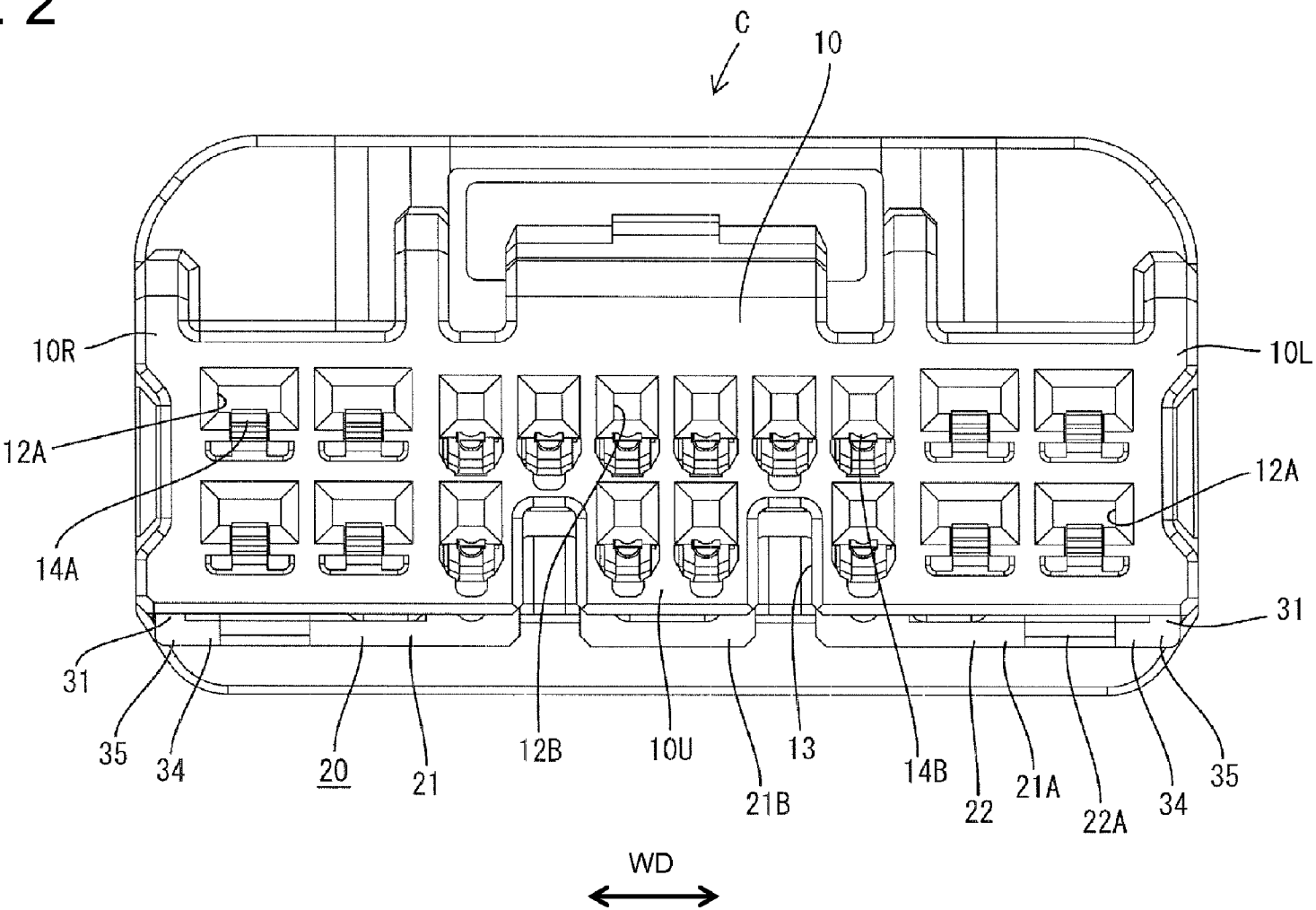
FIG. 2 is a front view of the connector with the retainer at a partial locking position.
Figure 7:
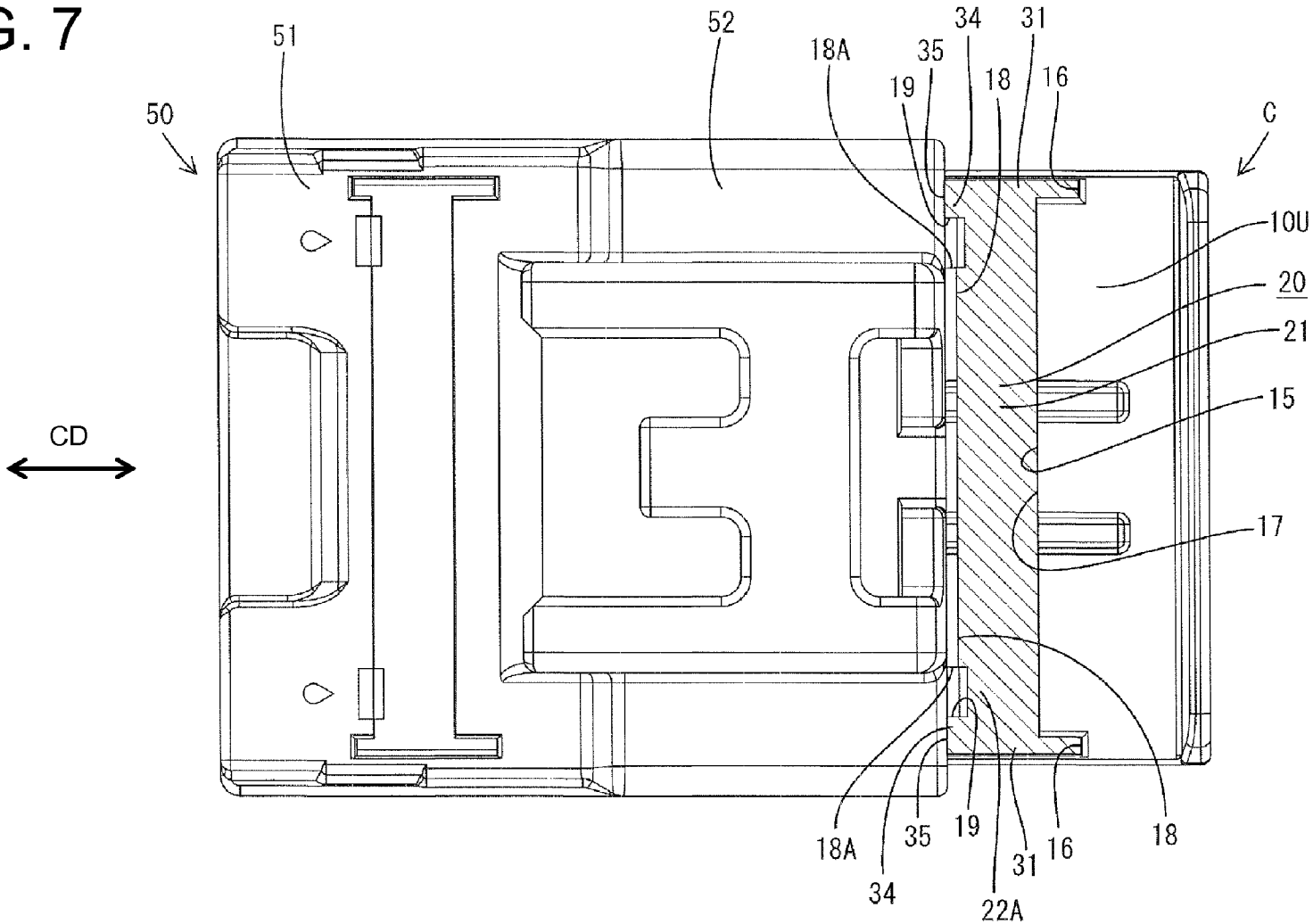
FIG. 7 is a bottom view showing a state where the insufficiently inserted retainer is in contact with the receptacle.

A connector in accordance with the invention is identified by the letter C in FIGS. 1, 2 and 7. The connector C is a hybrid type connector that has both large and small terminals and is connectable with a mating connector 50. Ends of the connectors C, 50 that are to be connected are referred to as the front ends. Additionally, the orientation of FIG. 2 provides the basis for reference to the upper, lower, left and right sides.

The mating connector 50 includes a housing 51 made e.g. of synthetic resin and a forwardly open tubular receptacle 52 is provided in a front part of the housing 51. Tabs of unillustrated mating terminals are held in the housing 51 and project forward in the receptacle 52. Ribs (not shown) project in from the bottom wall of the receptacle 52.

The connector C includes a synthetic resin housing 10 that can be inserted into the receptacle 52 of the mating connector 50. Large and small terminals (not shown) are accommodated in the housing 10 in conformity with magnitudes of permissible current values. The terminals are connected respectively with ends of unillustrated wires and include connecting portions that are connectable electrically with the tabs of the mating terminals. The lengths of the large terminals for high current and the small terminals for low current differ in forward and backward directions.

Large cavities 12A are formed at opposite side portions of the housing 10 in a width direction WD for accommodating the large terminals, and small cavities 12B are formed in an intermediate part of the housing 10 for accommodating the small terminals (see FIG. 2). The large and small cavities 12A and 12B are formed respectively in upper and lower levels and are arranged side by side in the width direction WD at the same height in each level.

Four large cavities 12A are formed at each of the opposite side portions of the housing 10, and the large cavities 12A in the upper and lower levels are substantially vertically aligned. Six small cavities 12B are provided in the upper level and four small cavities 12B are provided in the lower level. The small cavities 12B in the upper level are arranged at equal intervals in the width direction WD and those in the lower level are vertically aligned with the corresponding small cavities 12B in the upper level. Rib insertion grooves 13 are formed at the inner sides of the outermost small-size cavities 12B in the lower level for permitting passage of the ribs of the receptacle 52.

Groups of the large cavities 12A and a group of the small cavities 12B are spaced apart by a distance slightly larger than the interval between the adjacent small cavities 12B. The surrounding wall of the housing 10 has a bottom wall 10U that is slightly thicker below the large cavities 12A than below the small cavities 12B. The surrounding wall of the housing 10 also has a left wall 10L and a right wall 10R that are thicker, for example, than left and right walls of a housing formed with only small cavities or those of a housing formed with small cavities at the opposite side portions.

The large and small cavities 12A and 12B penetrate the housing 10 in forward and backward directions. Locking lances 14A, 14B are cantilevered at wall surfaces of the cavities 12A, 12B and are resiliently displaceable vertically. The locking lances 14A, 14B engage the rear ends of the connecting portions of the respective terminals when the terminals are accommodated respectively to proper depths in the corresponding cavities 12A, 12B to retain the terminals (primary locking). The rear ends of the connecting portions of the small terminals are aligned in the lateral direction when the small terminals are accommodated at the proper depths in the corresponding cavities 12A. Similarly, the rear ends of the connecting portions of the large terminals are aligned in the lateral direction when the respective terminals are accommodated at the proper depths of the corresponding cavities 12B. Additionally, the rear ends of the connecting portions of the large terminals are more backward than the rear ends of the connecting portions of the small terminals when the respective terminals are accommodated at proper depths of the corresponding cavities 12A, 12B.

The bottom wall 10U of the housing 10 is formed with a retainer insertion opening 15, and the connector C includes the retainer 20 to be inserted from below into the retainer insertion opening. The retainer 20 is laterally wide and has a width substantially equal to a dimension of the housing 10 in the width direction WD.

The retainer 20 has a main body 21 with large and small walls 21A and 21B to be inserted in forward and backward directions into intermediate parts of the respective large and small cavities 12A and 12B. The large walls 21A are at the opposite left and right sides of the small wall 21B and are smaller in forward and backward directions than the small wall 21B.

Bottom walls 22 are provided before the large walls 21A. Each bottom wall 22 is a substantially horizontal plate unitary to the bottom end of the large wall 21A. The bottom walls 22 close parts of the retainer insertion opening 15 before the large walls 21A when the retainer 20 is mounted at a full locking position. Other parts of the retainer insertion opening 15 are closed at least partly by the small wall 21B, the large walls 21A and/or the side wall 31. The retainer 20 is movable between a partial locking position where the insertion and withdrawal of the respective terminals are permitted and the full locking position where the respective terminals are retained. The retainer 20 is accommodated entirely in the housing 10 at the full locking position so that the bottom surface of the retainer 20 is substantially flush with the bottom surface of the housing 10. However, bottom parts of the retainer 20, including the bottom walls 22, project down and out from the housing 10 when the retainer 20 is at the partial locking position (see FIG. 2).

Figure 3:
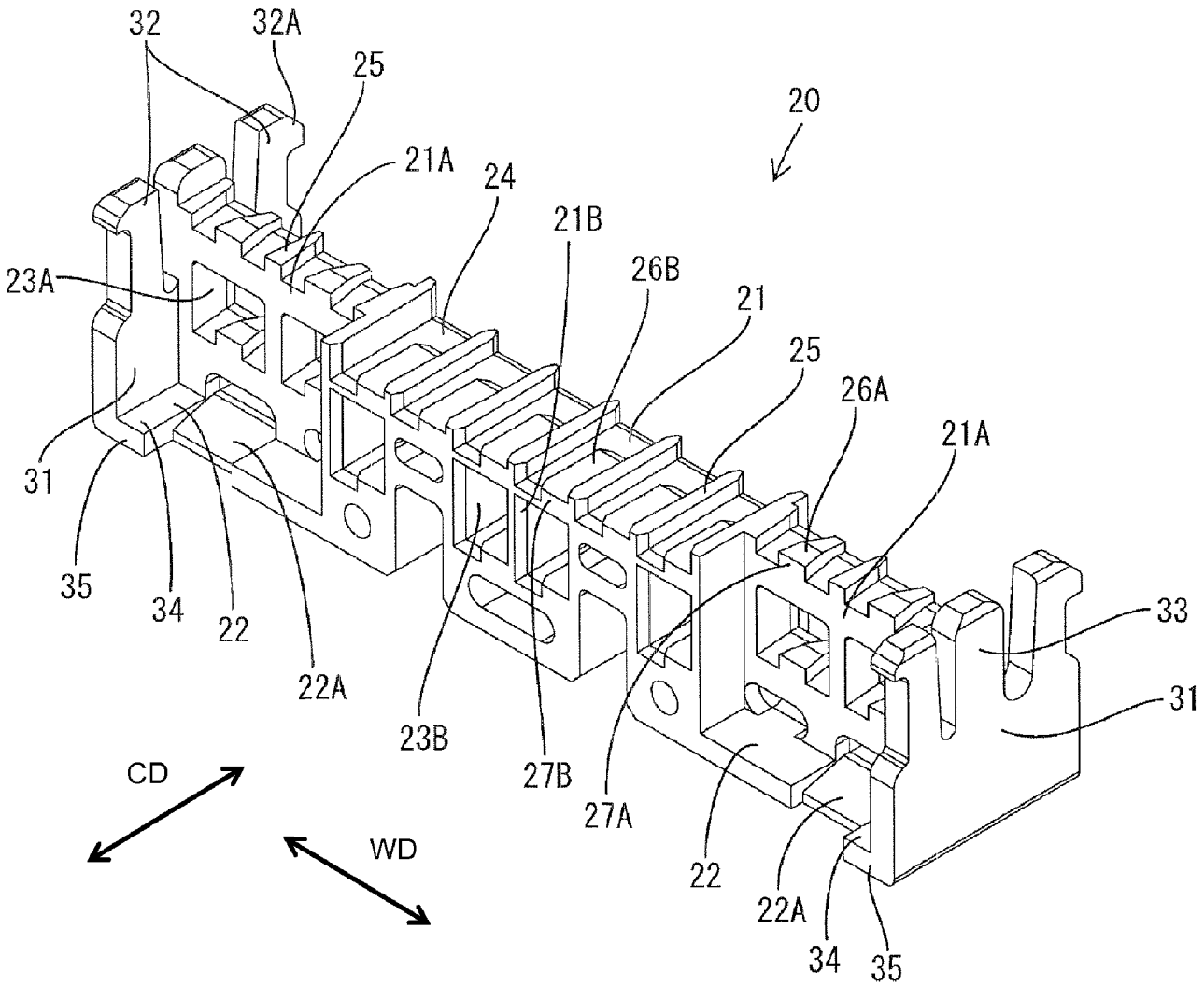
FIG. 3 is a perspective view of the retainer.

Jig contacts 22A are recessed back on the bottom walls 22 so that clearances are defined between the front edges of the jig contacts 22A and the front end of the retainer insertion opening 15 (see FIG. 7) for receiving a jig. The leading end of the jig can be inserted into this clearance to detach the retainer 20 from the housing 10. The upper surface of each jig contact 22A is inclined as gradually thin the jig contact 22A toward the front (see FIG. 3).

Large through holes 23A and small through holes 23B penetrate the large walls 21A and the small wall 21B in forward and backward directions. The large and small through holes 23A and 23B communicate respectively with the large and small cavities 12A and 12B in the lower level when the retainer 20 is mounted at the full locking position. An upper plate 24 defines ceilings of the large and small through holes 23A and 23B and constitutes the bottom walls of the large and small cavities 12A and 12B in the upper level. Partition walls 25 are provided on the upper surface of the upper plate 24 in conformity with the positions of partition walls partitioning the respective large and small cavities 12A and 12*b* in the upper level.

The main body 21 of the retainer 20 includes large and small engaging portions 26A and 26B arranged side by side in the width direction WD and engageable with the large and small terminals accommodated respectively in the large and small cavities 12A and 12B.

The large and small engaging portions 26A and 26B are provided in a one-to-one correspondence with the respective large and small through holes 23A and 23B and in a one-to-one correspondence with the respective partition walls 25 of the upper plate 24. The large and small engaging portions 26A and 26B are retracted respectively to positions so as not to interfere with the large and small terminals when the retainer 20 is at the partial locking position while projecting into the corresponding cavities 12A, 12B to engage the rear ends of the connecting portions of the corresponding terminals when the retainer 20 is moved to the full locking position. Engaging surfaces 27A, 27B of the large and small engaging portions 26A and 26B are formed respectively to be flush with the front surfaces of the large and small walls 21A and 21B. Thus, the engaging surfaces 27A of the large and small engaging portions 26A are more backward than the engaging surfaces 27B of the small engaging portions 26B.

Figure 5:
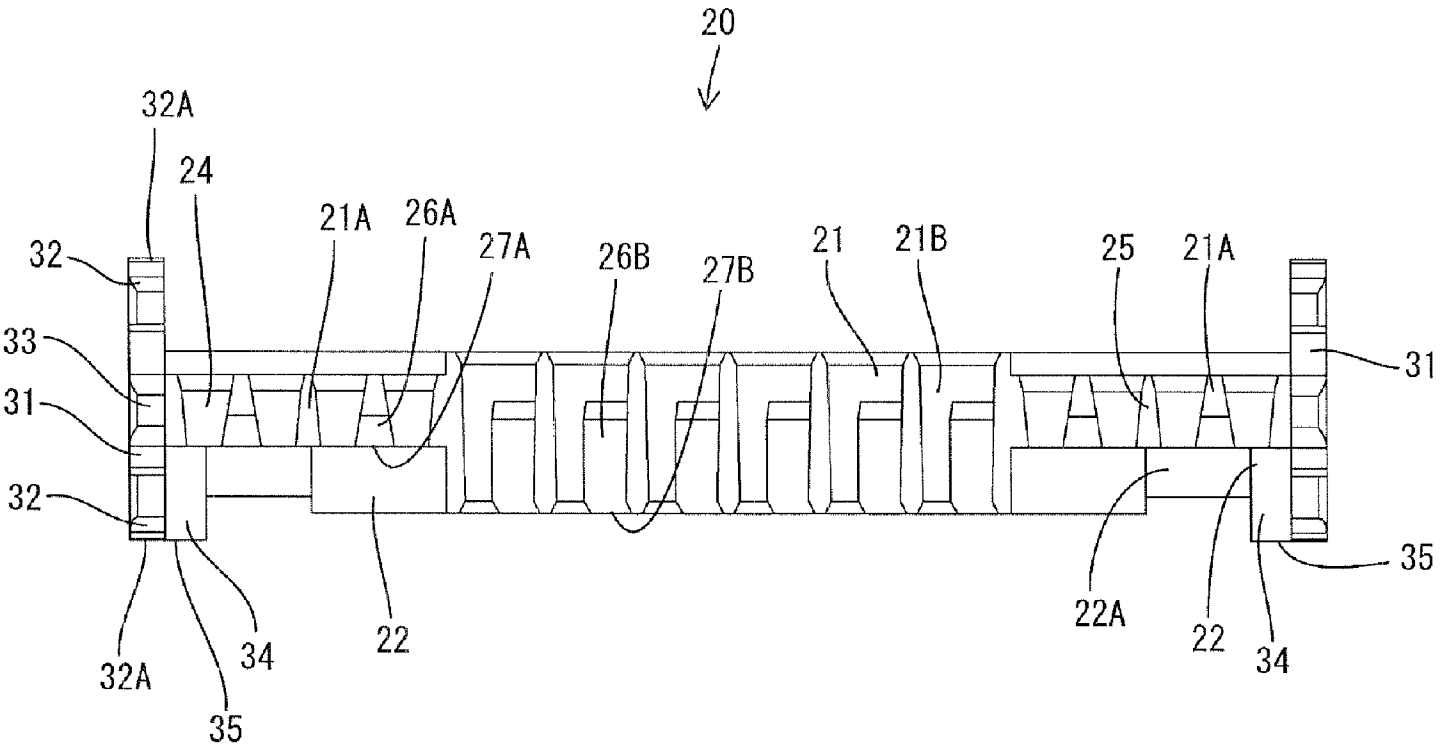
FIG. 5 is a plan view of the retainer.
Figure 6:
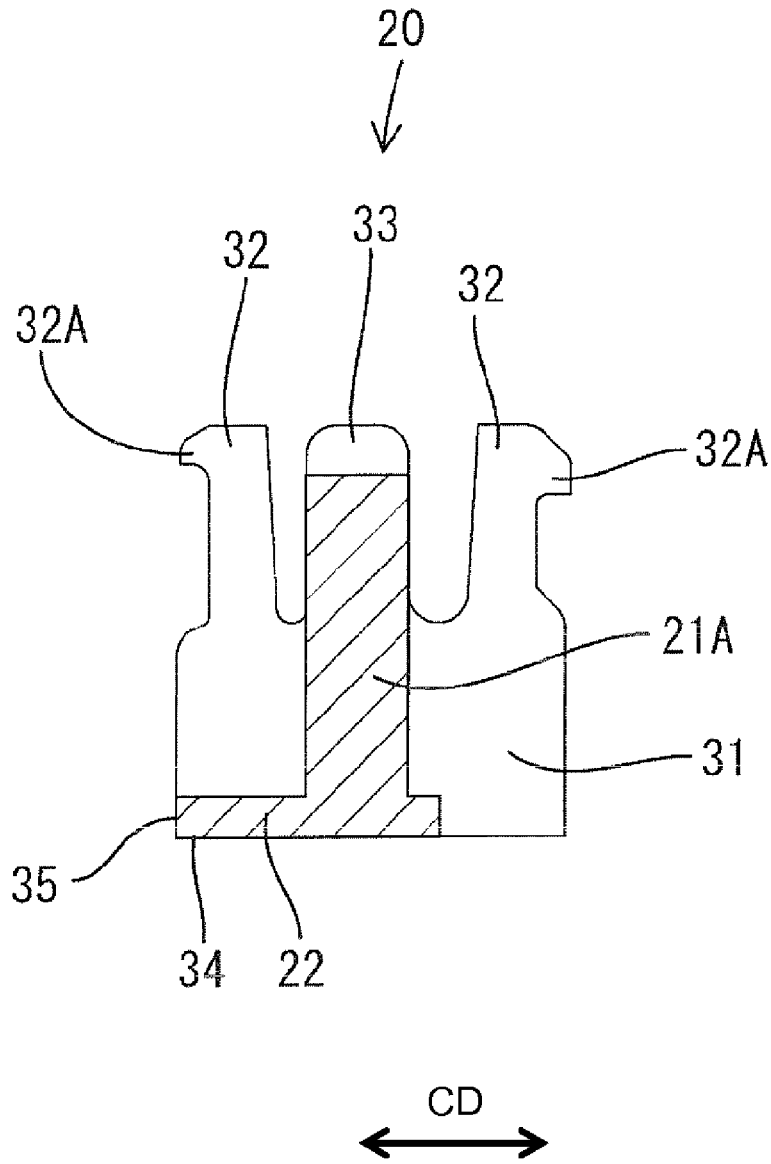
FIG. 6 is a section along A-A of FIG. 4.

Two side walls 31 are provided at the opposite widthwise ends of the retainer 30. The respective side wall portions 31 project forward and backward from the large walls 21A by substantially the same distance, and project more forward than the small walls 21B and the bottom walls 22 (see FIG. 5). Thus, the retainer 20 is substantially H-shaped when viewed in the vertical direction.

Two locking arms 32 project up at the front and rear ends of each of the side walls 31. The locking arms 32 are resiliently displaceable in directions toward each other. Locks 32A are provided at the leading ends of the respective locking arms 32 and project in directions opposite to facing directions of the locking arms 32. The rear locking arms 32 are engageable with partial locking projection (not shown) of the housing 10, and the front locking arm 32 is engageable with a full locking projection (not shown). In this way, the retainer 20 is held at the respective partial and full locking position.

Each side wall 31 includes an intermediate wall 33 that projects between the locking arms 32. The dimension of the intermediate wall 33 in forward and backward directions exceeds the dimension of the respective locking arms 32 in forward and backward directions and is equal to the dimension of the large wall 21A in forward and backward directions. The respective side walls 31 are unitary to the large walls 21A, and only the upper ends thereof project up from the large walls 21A. The locking arms 32 and the intermediate walls 33 have substantially the same height.

Figure 4:
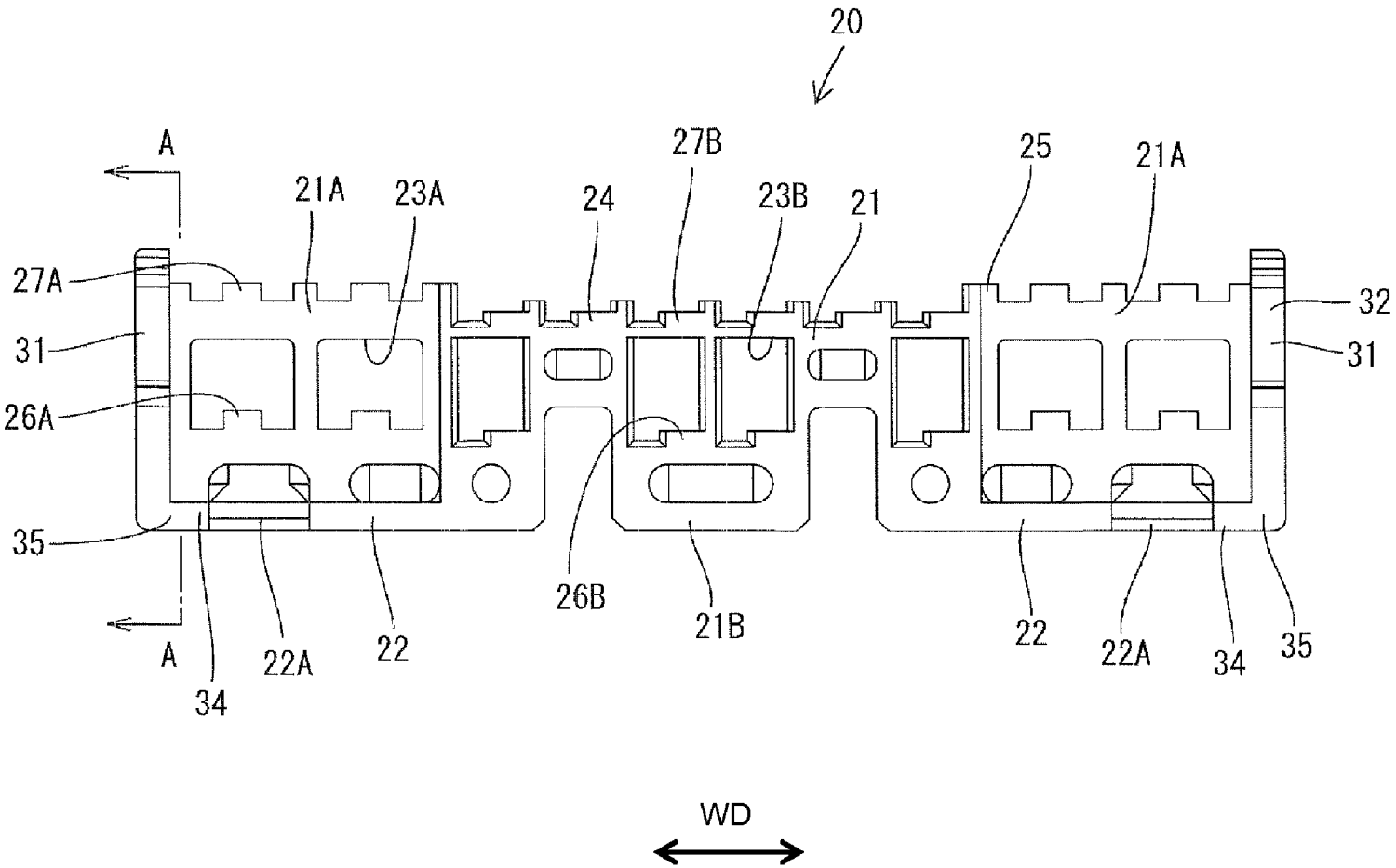
FIG. 4 is a front view of the retainer.

Reinforcements 34 project toward one another from the bottom ends (rear ends in an inserting direction ID of the retainer 20 into the housing 10) of the projecting parts of the respective side walls 31. The reinforcements 34 are plates that are substantially continuous with the bottom ends of the side walls 31 and extend substantially at right angles from the side walls 31. Thus, the reinforcements 34 and the side walls 31 are substantially L-shaped (see FIG. 4) when the retainer 20 is viewed from the front. A dimension of the reinforcements 34 in forward and backward directions is equal to a projecting distance of the side walls 31 from the bottom walls 22, so that the front end surfaces of the reinforcements 34 and the front surfaces of the side walls 31 form flat contact surfaces 35". The contact surfaces 35 are substantially parallel to the front surface of the main body 21 of the retainer 20 and are substantially orthogonal to the connecting direction CD of the connectors C, 50. The contact surfaces 35 are substantially L-shaped when viewed from front.

The reinforcements 34 have the same vertical thickness as the bottom walls 22 and are unitary with the bottom walls 22. The reinforcements 34 project forward from the bottom walls 22 and project inwardly from the side walls 31 to have a square shape when viewed in the vertical direction. A lateral dimension of the reinforcements 34 is slightly larger than the thickness of the respective side walls 31 and is substantially equal to the lateral dimension of parts of the bottom walls 22 between the jig contacts 22A and the side walls 31.

The retainer insertion opening 15 has a substantially rectangular shape that is long in the width direction WD of the housing 10 (arrangement direction of the cavities 12A, 12B) as shown in FIG. 7. Side wall inserting portions 16 are defined at the opposite ends of the retainer insertion opening 15 for receiving the side walls 31 of the retainer 20. Further, a main body inserting portion 17 is defined between the side wall inserting portions 16 for receiving the main body 21 of the retainer 20.

The main body inserting portion 17 has a substantially rectangular shape that is long in the width direction WD. The dimension of the main body inserting portion 17 in forward and backward directions is substantially equal to the dimension of the small walls 21B of the retainer 20 in forward and backward directions over substantially the entire width. A hollow is formed above the main body inserting portion 17. The hollow crosses intermediate sections of the large and small cavities 12A and 12B in the lower level in forward and backward directions and communicates with the respective cavities 12A, 12B in the upper level. Parts of the hollow above the main body inserting portion 17 have a width in forward and backward directions for receiving the large walls 21A of the reinforcement and are narrowed in conformity with the width of the large walls 21A in forward and backward direction. Thus, bottom wall accommodating portions 18 are formed by recessing parts of the main body inserting portion 17 that receive the large walls 21A and have depths equal to the thickness of the bottom walls 22. The bottom walls 22 fit in the bottom wall accommodating portions 18 when the retainer 20 is at the full locking position.

The side wall inserting portions 16 have a substantially rectangular shape narrow and long in forward and backward directions and front and rear ends of the side wall inserting portions 16 project forward and backward from the main body inserting portion 17. The opposite side wall inserting portions 16 are formed in the left and right walls 10L, 10R of the housing 10 (see FIG. 2). Hollows are formed above the respective side wall inserting portions 16 for receiving the side walls 31. The partial locking projections and the full locking projections are formed on wall surfaces of the hollows for engaging the locking arms 32 of the side walls 31. The full locking projections are formed on the rear wall surfaces and the partial locking projections are formed on the front wall surfaces, with the full locking projections being deeper and more upward than the partial locking projections.

Reinforcement accommodating portions 19 are formed at the opposite widthwise sides of the main body inserting portion 17 for receiving the reinforcements 34 of the retainer 20. The reinforcement accommodating portions 19 are recessed in the bottom wall 10U of the housing 10 to be substantially continuous with the bottom wall accommodating portions 18 of the main body inserting portion 17 and the side wall inserting portions 16. The depth of the reinforcement accommodating portions 19 is substantially equal to the depth of the bottom wall accommodating portions 18. Additionally, the reinforcement accommodating portions 19 are formed mostly in the range of the left or right wall 10L or 10R of the housing 10.

The bottom wall 10U of the housing 10 is formed with jig recesses 18A. The jig recesses 18A are formed at the peripheral edge of the retainer insertion opening 15 before parts of the retainer insertion opening 15 where the jig contacts 22A are accommodated. The jig recesses 18A are shallower than the bottom wall accommodating portions 18 of the retainer insertion opening 15 to facilitate the insertion of the jig into the jig contacts 22A.

The retainer 20 is held at the partial locking position before the connector C is connected with the mating connector 50 and the terminals are inserted into the corresponding cavities 12A, 12B from behind. The retainer 20 is pushed in the inserting direction ID to the full locking position after all of the terminals are inserted. The large and small engaging portions 26A and 26B of the retainer 20 then are engaged respectively with the terminals so that the terminals then are locked doubly by the locking lances 14A, 14B and the retainer 20. The connector C then is pushed toward the mating connector 50 in the connecting direction CD so that the retainer 20 is accommodated substantially completely in the housing 10 does not interfere with the receptacle 52. Thus, the housing 10 is fit smoothly into the receptacle 52 and the two connectors C, 50 reach a properly connected state.

An operator may forget to move the retainer 20 to the full locking position after inserting the terminals into the cavities 12A, 12B or may leave the retainer 20 inserted halfway even though an attempt is made to move the retainer 20 to the full locking position. In such cases, the bottom end of the retainer 20 projects from the housing 10 and the contact surfaces 35 at the front of the bottom end contact the open end of the receptacle 52 to prevent further connection. Thus, the operator knows that the retainer 20 is inserted insufficiently and has not been pushed completely to the full locking position. Only the front ends of the side walls of the prior art connector contact the receptacle 52, and hence the side walls may break and the two connectors may be connected forcibly. As a result, the insufficient insertion of the retainer may not be detected. Then, the terminals may not be reliably doubly locked. If the terminals are not inserted to proper depths, the retainer 20 pushes any insufficiently inserted terminals forward to proper positions as the retainer 20 is pushed to the full locking position. However, the retainer pushed halfway may deform the terminals if the connector is connected forcibly with the terminals and the retainer left insufficiently inserted.

However, in this embodiment, the inwardly projecting reinforcements 34 at the projecting ends of the side walls 31 of the retainer 20 contact the receptacle 52 when the retainer 20 is inserted insufficiently. Thus, connection with the mating connector 52 cannot be carried out and insufficient insertion of the retainer 20 is detected reliably. The reinforcements 34 are provided only at the bottom ends of the side walls 31 and project in from the front ends of the respective side wall portions 31. Thus, it is not necessary to increase the entire thickness of the side walls 31 and enlarge the connector C in the width direction. The reinforcements 34 are formed only at the opposite ends of the main body 21 of the retainer 20. Thus, the bottom wall 10U of the housing 10 is thinned to accommodate the reinforcements 34 only at the opposite ends of the housing 10 where the reinforcement accommodating portions 19 are formed. Accordingly, influence on the flow of resin is suppressed to a minimum, and the wall of the housing 10 need not be thickened. In other words, insufficient insertion of the retainer 20 can be detected reliably without enlarging the connector C.

The side walls 31 and the reinforcements 34 are unitary. Thus, the side walls 31 will not be damaged even if the housing 10 is pushed obliquely into the mating connector 50. In contrast, the reinforcements and the side walls of the prior art connector are spaced apart in the width direction of the retainer. Hence, only the reinforcements or the side walls may contact the receptacle 52 and damage may not be escaped if the prior art housing is pushed slightly obliquely into the receptacle 52. However, the side walls 31 and the reinforcements 34 are provided unitarily in this embodiment. Therefore, a contact force invariably is distributed between the side walls 31 and the reinforcements 34 and the insufficient insertion of the retainer 20 can be detected reliably even if the housing 10 is pushed in obliquely.

The large and small terminals are accommodated in the housing 10 with the small terminals in the widthwise middle of the housing 10 and the large terminals accommodated at the opposite end portions of the housing 10. Thus, the thickness of the left and right walls 10L, 10R of the housing 10 are inevitably larger as compared with the case where the small terminals are at the opposite ends of the housing. Thus, the reinforcement accommodating portions 19 for accommodating the reinforcements 34 rationally are provided in the parts of the housing 10 where the wall thickness is inevitably large.

The invention is not limited to the above described and illustrated embodiment. For example, the following embodiments are also embraced by the technical scope of the present invention as defined by the claims.

The invention is applied to the hybrid type connector C in the above embodiment. However, the invention also is applicable to various types of connectors C (e.g. having terminal fittings of the same or similar type) without being limited to the above application.

The reinforcements 34 project forward from the bottom walls 22 and inwardly from the side walls 31 and are substantially square-shaped when viewed in the vertical direction in the above embodiment. However, the shape of the reinforcements 34 is not limited to this and may have, for example, a trapezoidal shape whose lateral width gradually decreases toward the back.

What is claimed is:

1. A connector, comprising:

a housing having a front end configured to fit into a receptacle of a mating connector along a connecting direction, and a rear end opposite the front end, cavities formed in the housing for accommodating terminals, the housing having a bottom wall and left and right housing side walls extending up from the bottom wall, a retainer insertion opening extending into the bottom wall and communicating with the cavities; and a retainer configured for insertion into the housing in an inserting direction aligned at an angle to the connecting direction, the retainer including a main body with engaging portions engageable with the terminals, left and right retainer side walls at opposite left and right ends of the main body, the retainer side walls having front ends forward from the main body in the connecting direction of the connector with the mating connector and left and right spaced apart reinforcements projecting inwardly and toward one another from front end portions of the respective left and right retainer side walls in the connecting direction of the connector with the mating connector and at trailing ends of the retainer side walls in the inserting direction of the retainer into the housing, front edges of the reinforcements and front edges of the retainer side walls being substantially aligned with one another in directions parallel to the inserting direction of the retainer into the housing, jig contacts being formed on the retainer substantially adjacent to the reinforcements so that the reinforcements are between the jig contacts and the respective retainer side walls, the jig contacts being spaced rearward of the front edges of the reinforcements so that jig recesses are defined between front edges of the jig contacts and a rearwardly facing front edge of the bottom wall at the retainer insertion opening for receiving a jig.

2. The connector of claim 1, wherein the cavities are arranged side by side in the housing, and wherein the engaging portions are arranged side by side on the main body of the retainer, the retainer side walls being at opposite ends of the main body in an arrangement direction of the engaging portions.

3. The connector of claim 2, wherein the cavities include small cavities in an intermediate part of the housing in an arrangement direction of the cavities and the large cavities at opposite lateral sides of the housing.

4. The connector of claim 1, wherein the retainer side walls portions and the reinforcements are unitary with one another.

5. The connector of claim 1, wherein the reinforcements are continuous with the trailing ends of the retainer side walls with respect to the inserting direction and are at substantially right angles to the retainer side walls so that the reinforcements and the retainer side walls define substantially L-shapes when viewed along the connecting direction.

6. The connector of claim 1, wherein front end surfaces of the reinforcements and front surfaces of the retainer side walls form substantially flat contact surfaces.

7. The connector of claim 1, wherein front end surfaces of the reinforcements and front surfaces of the retainer side walls form contact surfaces that are substantially parallel to a front surface of the main body of the retainer and are substantially orthogonal to the connecting direction of the connectors.

8. The connector of claim 7, wherein the contact surfaces are substantially L-shaped when viewed in the connecting direction.

9. The connector of claim 1, wherein the retainer is configured so that any of the terminals that are inserted insufficiently are pushed forward by the retainer to proper positions as the retainer is being inserted into the housing.

10. The connector of claim 1, further comprising first and second locking arms on each of the retainer side walls, the locking arms on each of the retainer side walls being resiliently displacement in directions towards each other, a lock being formed on a leading end of each of the locking arms and being engageable with a locking projection of the housing.

11. The connector of claim 1, wherein the retainer insertion opening has a main body insertion portion and reinforcement accommodating portions on opposite left and right sides of the main body insertion portion, the reinforcement accommodating portions being at least partly aligned with the left and right walls of the housing.

* * * * *